US005351965A

United States Patent [19]

Telfer et al.

[11] Patent Number: 5,351,965

[45] Date of Patent: Oct. 4, 1994

[54] APPARATUS FOR PLAYING A BOARD GAME

[76] Inventors: Stephen J. Telfer, 74 Windsor St., Arlington, Mass. 02174; Michael J. Zuraw, 3 Brattle Dr., Arlington, Mass. 02174

[21] Appl. No.: 119,040

[22] Filed: Sep. 10, 1993

[51] Int. Cl.[5] ..... A63F 3/00

[52] U.S. Cl. ..... 273/260; 273/283; 273/284

[58] Field of Search ..... 273/260, 261, 275, 282.1, 273/283, 284, 290

[56] References Cited

U.S. PATENT DOCUMENTS

| | | | |
|---|---|---|---|
| 2,703,713 | 3/1955 | Moyer | 273/284 X |
| 2,732,211 | 1/1956 | Foster | 273/284 X |
| 3,163,425 | 12/1964 | Caplan | 273/284 |
| 3,608,902 | 9/1971 | Weisbecker | 273/283 X |
| 3,799,549 | 3/1974 | Laker | 273/284 X |
| 3,844,563 | 10/1974 | Isaac | 273/284 X |
| 4,079,941 | 3/1978 | Morales | 273/283 X |
| 4,364,568 | 12/1982 | Tracy | 273/284 X |
| 4,436,309 | 3/1984 | Barlow et al. | 273/275 X |
| 4,699,385 | 10/1987 | Bifulco | 273/260 |
| 4,753,441 | 6/1988 | Braus et al. | 273/284 X |
| 4,984,807 | 1/1991 | Shiryon | 273/284 X |
| 5,197,742 | 3/1993 | Bendit | 273/283 X |

FOREIGN PATENT DOCUMENTS

| | | | |
|---|---|---|---|
| 879179 | 2/1943 | France | 273/284 |
| 2610529 | 8/1988 | France | 273/284 |
| 7902074 | 9/1980 | Netherlands | 273/284 |

*Primary Examiner*—William E. Stoll
*Attorney, Agent, or Firm*—David J. Cole

[57] ABSTRACT

Apparatus for playing a game comprises a board bearing a two-dimensional grid of fixed playing areas, there being equal number of fixed playing areas of first and second colors; two equal sets of movable playing areas differing in color but having an equal number of movable playing areas therein, each of these movable playing areas being capable of resting upon one of the fixed playing areas; and two equal sets of playing pieces with at least three different types of playing pieces in each set, each playing piece having a first characteristic identifying the set to which it belongs, and a second characteristic identifying the type of playing piece within that set, each playing piece being capable of resting upon one of the fixed playing areas, or upon one of the movable playing areas which is itself resting in a fixed position upon one of the fixed playing areas.

17 Claims, 1 Drawing Sheet

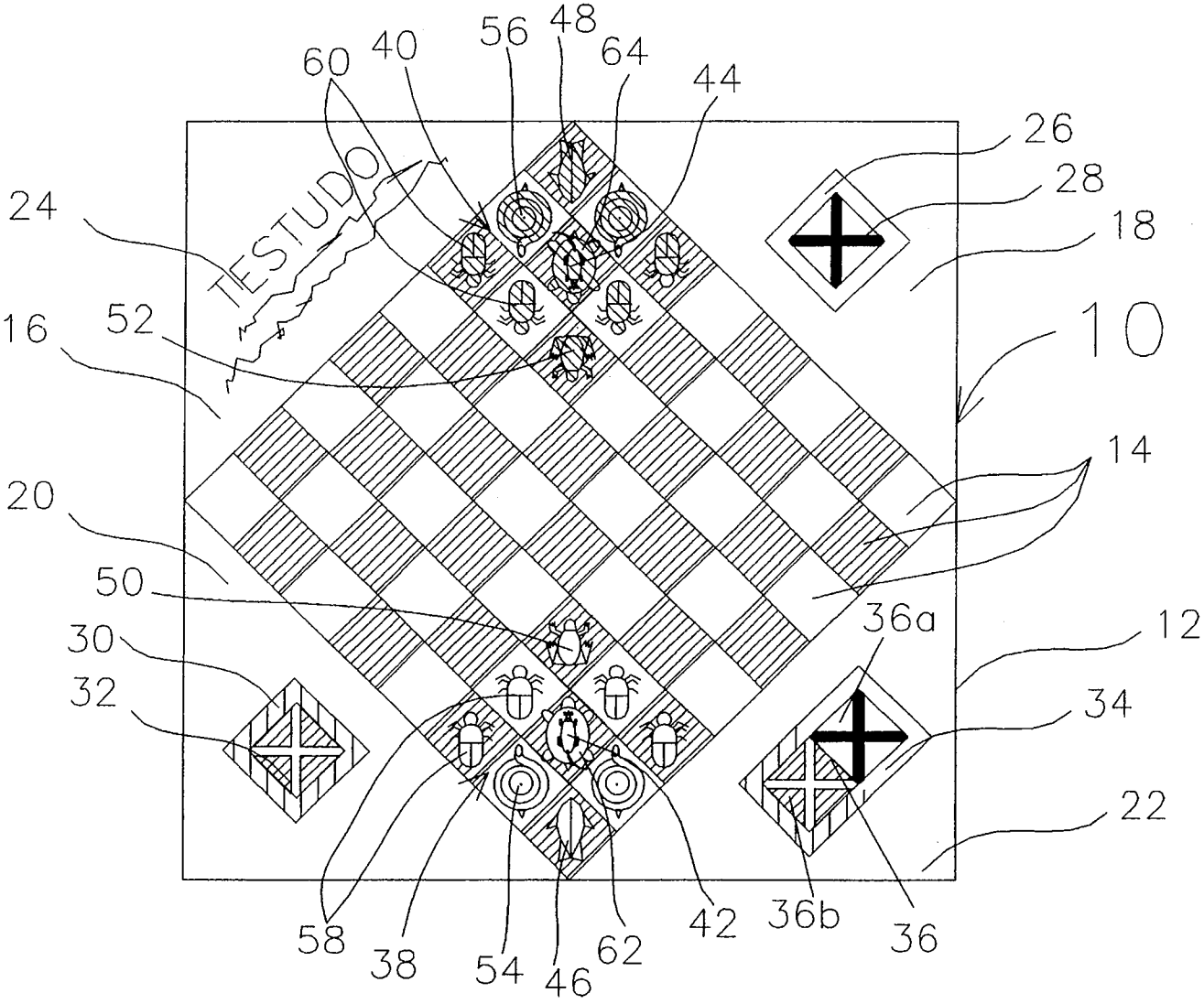
10
12
14
16
18
20
22
24
26
28
30
32
34
36
36a
36b
38
40
42
44
46
48
50
52
54
56
58
60
62
64
TESTUDO

APPARATUS FOR PLAYING A BOARD GAME

BACKGROUND OF THE INVENTION

This invention relates to apparatus for playing a board game. More particularly, this invention relates to such apparatus in which the players can alter the appearance of the game board during the course of a game.

Many board games are known having a board bearing a two-dimensional grid of fixed playing areas (typically squares), and two or more sets of playing pieces which are moved over the board by the players during the game, one set of playing pieces being under the control of each player. Apparatus for playing such board games may be divided broadly into two different types, a first type (exemplified by both ludo and checkers) in which all the pieces of a set are similar in appearance and can be moved in the same manner over the board during play, and a second type (exemplified by chess) in which the pieces of a set differ in appearance and move in different manners during play.

Throughout the history of chess and similar board games of this second type, much thought has been given to the types and numbers of playing pieces in each set and the manner in which they can be moved during play. The pieces and rules of the Western form of chess played in Europe and the Americas have been standardized for about the last 400 years, and require in each set sixteen pieces of six different types, each type moving differently during play (plus three special rules, namely pawns capturing diagonally although moving forwardly, the en passant rule, and the rule permitting simultaneous movement of the king and one rook during castling). However, several differing variants, including Chinese, Indian and Burmese, are still played in Asia, and as recently as the 1920's the grandmaster José Capablanca proposed the addition to the Western chess set of two further pieces (see Owner's Manual to the Chessmaster 3000 computer program, The Software Toolworks, Inc., Navato Calif. 94949 (1992)). Attempts have also been made to introduce three- and even four-dimensional chess.

Despite the prolific variation in the playing pieces and rules of chess and similar games, curiously little thought seems to have been given to the game board itself. Although the size of a chess board has varied during history (the Great Mogul Timor is said to have played a game called "Great Chess" on a 10×11 board, and the three- and four-dimensional chess games mentioned above obviously require extended boards), so far as the present inventors are aware, the board itself seems always to have been regarded simply as a passive grid over which the pieces are moved.

The present inventors have devised apparatus for playing a game in which the appearance of the game board is altered during play. The ability to alter the appearance of the game board during play enables the playing of a game which the present inventors believe to be at least as intellectually challenging as conventional chess but in which each set of playing pieces can include fewer pieces than conventional chess. Alternatively, more challenging versions of the game could be produced using no more playing pieces than in conventional chess.

SUMMARY OF THE INVENTION

Accordingly, this invention provides apparatus for playing a game, the apparatus comprising:

a board bearing a two-dimensional grid of fixed playing areas, equal numbers of said fixed playing areas being of first and second colors;

a first and a second set of movable playing areas, the first and second sets of movable playing areas differing in color but having an equal number of movable playing areas therein, each movable playing area not being substantially larger than one of the fixed playing areas but being capable of resting in a fixed position upon one of the fixed playing areas; and a first and a second set of playing pieces, each set of playing pieces comprising at least one first, at least one second and at least one third playing piece, the first and second sets of playing pieces having the same number of each type of playing piece therein, each of the playing pieces bearing a first indicium identifying it as a member of either the first or second set, and a second indicium identifying the type of playing piece within that set, each playing piece being capable of resting in a fixed position upon one of the fixed playing areas, and also being capable of resting in a fixed position upon one of the movable playing areas which is itself resting in a fixed position upon one of the fixed playing areas.

The phrase "capable of resting in a fixed position upon" is used herein to mean only that a playing piece can be placed upon a fixed or movable playing area without rolling or sliding across the board. This phrase does not imply any more than frictional contact between the playing piece and the underlying fixed or movable area, and does not necessarily imply the presence of cooperating detentes and recesses, or other cooperating members, on the playing piece and the underlying fixed or movable area to secure positive engagement therebetween, although the presence of such cooperating members is not excluded and obviously may be desirable in versions of the present apparatus intended for use during travel.

BRIEF DESCRIPTION OF THE DRAWING

The accompanying drawing is a top plan view of a preferred apparatus of the present invention with the various parts thereof shown in the position which they occupy at the beginning of a game, before either player has made his first move.

DETAILED DESCRIPTION OF THE INVENTION

The preferred apparatus (generally designated 10) of the present invention shown in the accompanying drawing comprises a game board 12, the central portion (or playing portion) of which bears a two-dimensional grid of fixed playing areas 14, alternate one of these fixed playing areas being of first and second colors. In the preferred apparatus, the grid is an 8×8 grid of square fixed playing areas (hereinafter for convenience called "fixed squares") all of the same size, but the grid itself need not have an equal number of rows and columns, and indeed, as discussed in more detail below, the fixed playing areas need not be squares or other quadrilaterals, but could, for example, have the form of equilateral triangles, and the fixed playing areas need not be arranged in the checkerboard pattern provided there are an equal number of fixed playing areas of the first and second colors. Also, for convenience, the fixed squares are shown as black and white, but could be of any two colors, provided they are readily distinguishable.

The areas of the board 12 outside the grid of fixed squares 14 have the form of four isosceles triangular areas 16, 18, 20 and 22. The area 16 is imprinted with a legend 24 giving the name the game, in this instance "TESTUDO," the name of the manufacturer and any other desired information, for example a copyright notice. The area 18 is imprinted with a white square first storage area 26 on which are stacked a first set of eight square movable playing areas 28 (hereinafter for convenience called "first tiles"). Similarly, the area 20 is imprinted with a black square second storage area 30 on which are stacked a second set of eight square movable playing areas 32 (hereinafter for convenience called "second tiles"). Finally, the area 22 is imprinted with a black-and-white rectangular third storage area 34 on which are stacked a set of eight rectangular double movable playing areas 36 (hereinafter for convenience called "double tiles").

The first and second tiles 28 and 32 respectively are of the same size as the fixed squares 14, and have the form of flat cuboids, so that, as described below, each of these tiles can be placed over one of the fixed squares 14, and a playing piece can rest upon the upper surface of the tile. The first tiles 28 have a light-colored upper surface, while the second tiles 32 have a dark-colored upper surface. If desired, the first tiles 28 can have a plain white upper surface to match the white fixed squares 14, while the second tiles 32 can have a plain black upper surface to match the black fixed squares 14. However, in order to assist players who have imperfect vision or who are playing in poor light, it is preferred that the upper surfaces of the first and second tiles 28 and 32 be readily distinguishable visually from the white and black fixed squares respectively, so that during play the players can determine at a glance whether a specific fixed square 14 is or is not covered by a tile 28 or 32. To render the tiles 28 and 32 readily distinguishable from the white and black fixed squares 14, the upper surfaces of the tiles may be made slightly different in color from the fixed squares 14; for example, if the fixed squares are white and black, the tiles could have yellow and grey upper surfaces. Alternatively, the upper surfaces of the tiles 28 and 32 may bear a pattern which distinguishes them from the plain fixed squares; the drawing shows the first tiles 28 having on their upper surface a black cross on a white ground, and the second tiles 32 having on their upper surfaces a white cross on a black ground.

The double tiles 36 have the form of flat cuboids of the same thickness as the first and second tiles 28 and 32 but having twice the area. Each double tile 36 consists of two square subsections, denoted 36*a* and 36*b* respectively, the subsection 36*a* being of the same size, shape and color as a first tile 28, and the subsection 36*b* being of the same size, shape and color as a second tile 32, the two subsections being joined along a common edge. Thus, each double tile 36 can rest upon and cover two fixed squares 14, so that one or two playing pieces can rest upon the upper surface of the double tile 36.

The apparatus 10 further comprises first and second sets of playing pieces, generally designated 38 and 40 respectively, these two sets of playing pieces having an equal number of each of six different types. Each playing piece bears a first indicium identifying it as belonging to the first or second set; conveniently, this first indicium comprises a color applied to at least part (and preferably the whole) of the external surface of the playing piece; in the specific apparatus shown, each of the pieces in the first set 38 has a completely white external surface, while each of the pieces in the second set 40 has a completely black external surface. Each playing piece also bears a second indicium identifying it as belonging to one of the six types of playing piece present in each set; conveniently, this second indicium comprises the shape of at least part (and preferably the whole) of the external surface of the playing piece; in the specific apparatus shown, the second indicium is provided by shaping the external surface of each type of playing piece in the form of a different animal. The first and second sets 38 and 40 each comprise:

(a) one first playing piece or turtle, 42 (white) or 44 (black);
(b) one second playing piece or fish, 46 or 48;
(c) one third playing piece or frog 50 or 52;
(d) two fourth playing pieces or snakes 54 or 56;
(e) four fifth playing pieces or beetles, 58 or 60; and
(f) one sixth playing piece or rat, 62 or 64.

At the beginning of each game, the two sets of playing pieces 38 and 40 are placed on the board 12 so that each set occupies a $3\times3$ array of fixed squares 14 at one end of one principal diagonal of the grid of fixed squares 14. The three end fixed squares of the principal diagonal extending from the end thereof are occupied by the fish, turtle and frog respectively, the two snakes are placed on the two fixed squares lying between the fish and the turtle, and the four beetles are placed on the four fixed squares lying between the frog and the adjacent edges of the grid and flanking the fixed squares occupied by the turtle and the two snakes. The rat 62 or 64 is placed upon the respective turtle 42 or 44; although not shown in the drawing, each turtle 42 or 44 is provided with a flat circular area on its upper surface so that any one of the other pieces may rest upon the upper surface of the turtle.

As already mentioned, during play the tiles 28, 32 and 36 may be placed to cover selected ones of the fixed squares 14. If a first tile 28 is placed on a black fixed square 14, that fixed square becomes white for the purposes of the game, while if a second tile 32 is placed on a white fixed square 14, that fixed square becomes black for the purposes of the game. Obviously, a double tile 32 can change the color of two adjacent fixed squares. Since the rules of the game (discussed in more detail below) require that the movement of certain pieces be restricted by the colors of the squares over which the piece moves, changing the colors of fixed squares 14 by placing tiles 28, 32 and 36 thereon alters the permissible moves of these pieces.

Moreover, the provision of the tiles 28, 32 and 36 provides an additional variation in the fixed squares 14, in that each square 14 can not only be black or white, but can be either "down" (when no tile is placed upon the fixed square) or "up" (when a tile covers the fixed square). The rules of the game require that the movement of certain pieces be restricted by the "height" (i.e., up or down status) of the squares over which the piece moves. Thus, the placement of the tiles 28, 32 and 36 upon the fixed squares 14 can modify both characteristics, namely color and height, of the squares 14. Note that the height and color of a fixed square can be varied independently, since, for example, placing a white tile 28 upon a white fixed square 14 changes the height of the square but not its color.

This ability to vary two characteristics of the fixed squares on the game board provides additional degrees of complexity, challenge and interest to the game, as compared with conventional board games in which the board is simply a static, unchanging background.

A preferred set of rules for playing a game with the apparatus shown in the drawing is as follows:

TESTUDO

TESTUDO is a game of strategy for two players which takes place on a game board representing a swamp. The set you have just purchased should contain the following apparatus for the game:

One board printed with a checkerboard representing the swamp.

Two sets, each of ten pieces, and each representing the small animals living in the swamp, namely four beetles, two snakes, one rat, one frog, one fish and one turtle.

Eight black tiles ("floating squares"), eight white floating squares and eight double floating squares. Floating squares resting upon the checkerboard are referred to as "UP" squares, while checkerboard squares are referred to as "DOWN" squares.

The object of the game is to land one of your pieces on your opponent's turtle.

How to play TESTUDO

1. Set up the apparatus as shown in the drawing, with the floating squares in their storage areas outside the checkerboard. Choose by lot which player is to have the white and black pieces; the player with the white pieces moves first.
2. In the first phase of the game, each player in turn places one floating square (black, white or double) on the checkerboard. A floating square can be placed on top of any one (or in the case of the double squares, any two) squares of the checkerboard, provided that the square on which it is placed does not have a piece or another floating square already occupying the square. Floating squares can be placed regardless of the color of the existing square (i.e., a white floating square can rest upon either a black or white existing square), but when a floating square is placed upon a checkerboard square of opposite color, it changes the color of the underlying square, i.e., a black checkerboard square carrying a white floating square is a white square for purposes of deciding which pieces may move on to, or across, that square. Each square on which a turtle rests is wild, and a player may treat such a square as either black or white, up or down at his election, and this election may be changed at each new move by the player. Once a floating square has been placed on the checkerboard, it may not be removed from the checkerboard. Also, a floating square may not be moved across the checkerboard until the third phase of the game, as described below.
3. When all the double floating squares have been placed on the checkerboard, even if some single floating squares remain unplaced, the second phase of the game begins. In this phase, at each turn each player may either (a) move one of his own pieces in the manner described in Section 4 below; or (b) place a single floating square, as described in Section 2 above.
4. The movements of the pieces are as follows:

(a) BEETLE A beetle may move any number of squares in a straight line (horizontally, vertically or diagonally) across squares which are the same color as the square it occupies at the beginning of the move, but may not jump over any other piece except the turtle. The beetle may move over or occupy both UP and DOWN squares. Since the square which a turtle occupies may be regarded as either white or black, a beetle resting on a turtle may move along a line of all black squares or a line of all white squares, at the player's election.

(b) SNAKE A snake may move any number of squares in a straight line (horizontally, vertically or diagonally), provided that the first square on to which it moves is of the opposite color from the square from which it moved, the second square is of the same color as the square from which it moved, and so on, with alternating squares of each color. The snake may not jump over any other piece except the turtle, but may move over and occupy both UP and DOWN squares. Since the square which a turtle occupies may be regarded as either white or black, a snake resting on a turtle may move on to either a black or white square initially, but thereafter must observe the rule about moving over squares of alternate colors.

(c) RAT A rat may move any number of squares in a straight line (horizontally, vertically or diagonally), but can move only on the UP squares, regardless of color, and may not jump over any other piece (except the turtle) or over a DOWN square.

(d) FISH A fish may move only on the DOWN squares, regardless of color, and moves only one or two squares at one move, but these squares do not need to be in a straight line, e.g., a fish may move one square horizontally, followed by one square diagonally. The fish may swim under any other piece or UP square separating its starting point and its destination. A fish may land on its own turtle.

(e) FROG A frog may move any number of squares in a straight line (horizontally, vertically or diagonally), provided that the first square on to which it moves is of the opposite height from the square from which it moved, the second square is of the same height as the square from which it moved, and so on, with alternating squares of each height. Thus, a frog on an UP square must move on to a series of DOWN, UP, DOWN, UP etc. squares. The frog may not jump over any other piece except the turtle, but may move over and occupy both black and white squares. Since the square which a turtle occupies may be regarded as either UP or DOWN, a frog resting on a turtle may move on to either a DOWN or UP square initially, but thereafter must observe the rule about moving over squares of alternate heights.

(f) TURTLE A turtle may move only on unoccupied DOWN squares, may move only one square in any direction at each move, and may not capture any piece other than the opposing turtle.

(g) Any piece may land on and occupy, or pass over, a square already occupied by a turtle of the same color. As mentioned above, the square occupied by a turtle is wild, and may be regarded as black or white, UP or DOWN.

5. If a piece (other than a turtle) lands on a square occupied by a piece of the opposite color, the piece which formerly occupied the square is captured and removed from the playing portion of the board. Except as provided in Section 2(g) above, a piece may not land on a square already occupied by a piece of the same color.
6. When all of the floating squares, single and double, have been placed on the checkerboard, the third phase of the game begins. In this phase, at each turn each player may either (a) move one of his own pieces in the manner described in Section 4 above; or (b) move one floating square, single or double, as described in Section 7 below.
7. If a player elects to move one floating square in accordance with Section 6, option (b) above, he may move the selected single or double floating square any number of places in a straight line, provided that the floating square does not pass over or alight on a square occupied by a piece (including a turtle) or another floating square; the floating square may be moved diagonally only if the squares touching the diagonal path are free from pieces and other floating squares. A floating square may be moved any number of times except that, when it is moved by one player, it may not be moved by the other player during his immediately following turn.
8. Neither a floating square nor a turtle can be moved when a piece is resting thereon.
9. If at any time any one or more of a player's pieces could land on his opponent's turtle at the player's next turn (the presence of another piece resting upon the turtle makes no difference), the player shall warn his opponent by saying "Turtle." This also applies if at any time the opponent makes a move which would enable any one or more of the player's pieces to land on the opponent's turtle at the player's next turn, and in this case after the player has said "Turtle," the opponent shall be permitted to retract the move and make any other permissible move, not necessarily with the same piece.
10. If at any time a player lands a piece on his opponent's turtle (regardless of whether another piece is already resting on the turtle), the game is ended, and the owner of the turtle on which the piece landed has lost.

It will readily be apparent to those familiar with board games that numerous changes and modifications can be made to the preferred apparatus described above, and to the rules for playing the game, without departing from the scope of the present invention. Obviously, the size and shape of the board, the number and type of playing pieces and movable playing areas and the rules governing the game can all vary widely. Without prejudice to the generality of the foregoing, examples of permissible variation include making the movable playing areas somewhat different in size and/or shape from the fixed playing areas, and the use of non-rectangular grids and/or playing areas. For example, a three-player version of the game could use an equilateral triangular grid of fixed playing areas, each of which could itself be an equilateral triangle, and three sets of playing pieces which start from the three vertices of the grid. In such a game, multiple movable playing areas could be double (in the form of a rhombus) or "quaternary" in the form of equilateral triangles have edges twice the length of the fixed playing areas. (Note that in the form of the game shown in the drawing, some or all of the double floating squares could be fused at a corner instead of along an edge.) A four-player version of the game could use a square grid of square fixed playing areas larger than that shown in the drawings and four sets of playing pieces. A variant of the game using a hexagonal grid of hexagonal playing areas would permit use by any number of players from two to six. The fixed playing areas need not all be of the same shape provided their pattern is regular; for example, the board might have both triangular and hexagonal fixed playing areas, or the fixed playing areas might have the form of right triangles obtained by dividing a square along a diagonal. The fixed playing areas need not be arranged in the alternating checkerboard pattern shown in the drawing, provided there are an equal number of fixed playing areas of the first and second colors. For example, the playing portion of the board might have alternate rows of fixed playing areas of the first or second colors, or each row might have two fixed playing areas of the first color followed by two fixed playing areas of the second color. Three-dimensional playing boards of the invention could also be constructed.

Finally, a fully electronic version of the game could be produced. In this case, of course, there would be no physical game board, movable playing areas or pieces; instead, the apparatus would comprise a computer programmed with instructions to generate images of the game board, movable playing areas and pieces. Using conventional programming techniques, the program could check the legality of attempted moves, and issue warnings such as the "Turtle" warning discussed above.

We claim:

1. Apparatus for playing a game, the apparatus comprising:

a board beating a two-dimensional grid of fixed playing areas, equal numbers of said fixed playing areas being of first and second colors;

a first and a second set of movable playing areas, the first and second sets of movable playing areas differing in color but having an equal number of movable playing areas in each set, each movable playing area not being substantially larger than one of the fixed playing areas but being capable of resting in a fixed position upon one of the fixed playing areas;

a plurality of multiple movable playing areas, each of said multiple movable playing areas comprising at least a first and a second subsection, the first subsection being of substantially the same size, shape and color as one of the first set of movable playing areas, and the second subsection being of substantially the same size, shape and color as one of the second set of movable playing areas, the subsections of each multiple movable playing area being fixedly joined together so that the multiple movable playing area can rest in a fixed position upon a plurality of said fixed playing areas; and a first and a second set of playing pieces, each set of playing pieces comprising at least one first, at least one second and at least one third playing piece, the first and second sets of playing pieces having the same number of each type of playing piece therein, each of said playing pieces having a first characteristic identifying it as a member of either the first or second set, and a second characteristic identifying the type of playing piece within that set, each playing piece being capable of resting in a fixed position upon one of the fixed playing areas, and also being capable of resting in a fixed position upon one of the movable playing areas which is itself resting in a fixed position upon one of the fixed playing areas, the numbers of movable playing areas in said first and second sets of movable playing areas, the number and sizes of said multiple movable playing areas, and the number of playing pieces in said first and second sets of playing pieces being such that all of said playing pieces, said movable playing areas and said multiple movable playing areas can be placed simultaneously on separate ones of said grid of fixed playing areas while still leaving a plurality of said fixed playing areas which are not occupied by a movable playing area, a multiple movable playing area or a playing piece.

2. Apparatus according to claim 1 wherein the fixed playing areas are arranged in a checkerboard pattern, with alternate ones of the fixed playing areas being of the first and second colors.

3. Apparatus according to claim 1 wherein the board bears, outside the grid of fixed playing areas, first and second storage areas on which the first and second sets respectively of movable playing areas may be placed.

4. Apparatus according to claim 3 wherein the board bears, outside the grid of fixed playing areas, first and second storage areas on which the first and second sets respectively of movable playing areas may be placed, and a third storage area on which the multiple movable playing area may be placed.

5. Apparatus according to claim 1 wherein each multiple movable playing area comprises only said first and second subsections the first and second subsections being fixedly joined together so that they may be placed in a fixed position upon two adjacent fixed playing areas which abut each other along an edge.

6. Apparatus according to claim 1 wherein each of the fixed playing areas is a quadrilateral of the same size and shape.

7. Apparatus according to claim 6 wherein each of the movable playing areas is a quadrilateral of substantially the same size and shape as each of the fixed playing areas, the first set of movable playing areas being substantially of the first color and the second set of movable playing areas being substantially of the second color.

8. Apparatus according to claim 6 wherein the two-dimensional grid of fixed playing areas has the same number of playing areas along each edge.

9. Apparatus according to claim 1 wherein the first characteristic comprises a color applied to at least part of the external surface of each playing piece, each of the playing pieces in each set sharing a common color, and the common color of the first set of playing pieces differing from that of the second set of playing pieces.

10. Apparatus according to claim 1 wherein the second characteristic comprises the shape of at least part of the external surface of each playing piece, the first, second and third playing pieces of the first set having the same shape as the first, second and third playing pieces respectively of the second set, and each of the first, second and third playing pieces differing in shape from the other two playing pieces.

11. Apparatus according to claim 1 wherein each of said first playing pieces has a flat surface upon which a second or third playing piece can rest.

12. Apparatus according to claim 1 wherein each of the first and second sets of playing pieces comprises one first playing piece, one second playing piece, one third playing piece, a plurality of fourth playing pieces, a plurality of fifth playing pieces and one sixth playing piece.

13. Apparatus according to claim 11 wherein each of the first and second sets of playing pieces comprises one first playing piece, one second playing piece, one third playing piece, two fourth playing pieces, four fifth playing pieces and one sixth playing piece.

14. Apparatus according to claim 1 wherein at least one playing piece in each of the first and second sets has the form of an animal.

15. Apparatus according to claim 1 wherein the numbers of movable playing areas in said first and second sets of movable playing areas, and the number and sizes of said multiple movable playing areas are such that when all of the movable playing areas and all of the multiple movable playing areas are placed on the board not more than about half of the fixed playing areas are covered by the movable playing areas and the multiple movable playing areas.

16. Apparatus according to claim 15 wherein the numbers of movable playing areas in said first and second sets of movable playing areas, and the number and sizes of said multiple movable playing areas are such that when all of the movable playing areas and all of the multiple movable playing areas are placed on the board exactly one half of the fixed playing areas are covered by the movable playing areas and the multiple movable playing areas.

17. Apparatus for playing a game, the apparatus comprising:

a board bearing a two-dimensional grid of fixed playing areas, alternate ones of said fixed playing areas being of first and second colors, each of the fixed playing areas being a quadrilateral of the same size and shape.

a first and a second set of movable playing areas, the first and second sets of movable playing areas having an equal number of movable playing areas in each set, each of the movable playing areas being a quadrilateral of substantially the same size and shape as each of the fixed playing areas, the first set of movable playing areas being substantially of the first color and the second set of movable playing areas being substantially of the second color;

a plurality of double movable playing areas, each of said double movable playing areas comprising first and second subsections, the first subsection being of substantially the same size, shape and color as one of the first set of movable playing areas, and the second subsection being of substantially the same size, shape and color as one of the second set of movable playing areas, said first and second subsections being fixedly joined together along a common edge such that said double movable area can rest in a fixed position upon two adjacent fixed playing areas of differing color; and a first and a second set of playing pieces, each set of playing pieces comprising at least one first, at least one second and at least one third playing piece, the first and second sets of playing pieces having the same number of each type of playing piece therein, each of said playing pieces having a first characteristic identifying it as a member of either the first or second set, and a second characteristic identifying the type of playing piece within that set, each playing piece being capable of resting in a fixed position upon one of the fixed playing areas, and also being capable of resting in a fixed position upon one of the movable playing areas which is itself resting in a fixed position upon one of the fixed playing areas, the board bearing, outside the grid of fixed playing areas, first and second storage areas on which the first and second sets, respectively, of movable playing areas may be placed, and a third storage area on which the multiple movable playing areas may be placed, the numbers of movable playing areas in said first and second sets of movable playing areas, the number of said double movable playing areas, and the number of playing pieces in said first and second sets of playing pieces being such that all of said playing pieces, said movable playing areas and said double movable playing areas can be placed simultaneously on separate ones of said grid of fixed playing areas while still leaving a plurality of said fixed playing areas which are not occupied by a movable playing area, a double movable playing area or a playing piece.

* * * * *